United States Patent [19]

Getgey

[11] Patent Number: 4,915,661

[45] Date of Patent: Apr. 10, 1990

[54] DISC TOY

[75] Inventor: William F. Getgey, Cincinnati, Ohio

[73] Assignee: Tedco, Inc., Hagerstown, Ind.

[21] Appl. No.: 152,440

[22] Filed: Feb. 5, 1988

[51] Int. Cl.[4] ..... A63H 27/00; A63B 65/00

[52] U.S. Cl. ..... 446/48; 273/425

[58] Field of Search ..... 446/46–47; 273/424, 425, 428, 58 K, 327

[56] References Cited

U.S. PATENT DOCUMENTS

| | | | |
|---|---|---|---|
| 1,292,011 | 1/1919 | Monroe | 273/424 |
| 2,690,339 | 9/1954 | Hall | 273/327 |
| 3,563,548 | 2/1971 | Tolotti . | |
| 3,566,532 | 3/1971 | Wilson | 446/46 |
| 3,659,849 | 5/1972 | Seymour | 446/266 X |
| 3,941,383 | 3/1976 | Clarke . | |
| 4,112,612 | 9/1978 | Woods . | |
| 4,616,827 | 10/1986 | Bergland . | |
| 4,687,210 | 8/1987 | Michel | 273/425 |

FOREIGN PATENT DOCUMENTS

| | | | |
|---|---|---|---|
| 289986 | 5/1928 | United Kingdom | 273/425 |

*Primary Examiner*—Mickey Yu

*Attorney, Agent, or Firm*—Woodard, Emhardt, Naughton, Moriarty & McNett

[57] ABSTRACT

A flying disc toy which may be thrown and is stable in flight in either a horizontal or vertical attitude. Because of its stability in flight in a vertical attitude, it may be bounced off of a rigid surface or wall. The toy is so configured and is made of a material which imparts a very high bounce to the toy off of a rigid surface, such as a concrete or brick surface.

2 Claims, 1 Drawing Sheet

DISC TOY

This invention relates to flying disc toys.

There have in the past been numerous flying disc toys, most of which are shaped as air foils when viewed in cross section. The air foil cross-sectional configuration is generally provided for purposes of imparting better flying characteristics to the disc, i.e., to enable the disc to remain in flight for prolonged periods of time and at relatively slow linear speeds. These air foils vary in configuration or shape in order to impart different flying characteristics to the disc. For example, some discs are so configured that when thrown in a horizontal rotating fashion, they will rise as they travel linearly and then fall slowly when they lose their linear speed. Others are designed so that they will fly in a loop and return to the thrower. Generally, though, the characteristic which the air foil design of the disc is intended to impart is one of maintaining the flying disc in a horizontal attitude and in flight at relatively slow, linear speeds.

A severe limitation of most flying disc toys is the limited number of ways in which the toy can be used for play purposes. For the most part, the toys are usable solely for purposes of tossing or throwing the disc back and forth between two individuals. Some are shaped or designed so that if thrown correctly, they will return to the thrower in the fashion of a boomerang, in which event one individual may play with the toy without having to chase it every time he throws it. Such return-type, flying disc toys, though, generally require a high degree of skill in order to obtain the return flight characteristic. Other flying discs have been configured so as to cause the disc to rotate 180 degrees during flight. Such discs rotate from flight on one side to flight on the opposite side or from a horizontal attitude with one side facing upwardly to a horizontal attitude with the opposite side facing upwardly during the flight of the disc. In the design of such flying disc toys, though, the effort is generally to create a flying toy which has additional toy characteristics or play values greater than simply an ability to fly through the air in a stable condition.

It has therefore been an objective of this invention to provide a flying disc toy which has greater play value than prior art flying disc toys.

Still another objective of this invention has been to provide a flying disc toy which has different play characteristics from any prior art flying disc toy.

In order to impart these additional or different play characteristics, as well as greater play values, it has been another objective of this invention to provide a flying disc toy which has many of the play characteristics of a flying disc, but also of a bouncing ball. To that end, the invention of this application comprises a flying disc which in flight is stable in either a horizontal attitude or a vertical attitude. In other words, when the toy is thrown while rotating about a horizontal axis with the disc in a vertical attitude, the toy will maintain that vertical attitude, and when thrown while rotating about a vertical axis with the disc in a horizontal attitude, it will maintain that horizontal attitude. Because of these flight characteristics, and particularly the stability of the flying disc while in a vertical attitude, the flying disc toy may be bounced off of a wall or a rigid surface in the fashion of a ball.

Yet another objective of this invention has been to provide a flying disc toy which has a very high bounce characteristic, i.e., when dropped vertically, it will bounce at least two-thirds of the height from which it was dropped. In one preferred embodiment of this invention, the toy is characterized by a bounce of 80 percent or more of the height from which it was dropped. For example, if dropped from a 4-foot height, the preferred embodiment of the toy will bounce approximately 3 feet, 6 inches in height. Furthermore, the configuration of the flying disc is such that it will maintain its vertical attitude upon the rebound. This characteristic of the toy enables the toy to be thrown against a wall and bounced back off of the ground or base to the thrower of the toy. Alternatively, it enables the toy to be thrown in a vertical attitude and bounced between two players. Or, because of its flight characteristics, it may be simply thrown through the air in either a horizontal or vertical attitude from one player to the other.

The flying disc toy of this invention which achieves all of these objectives and which has this very high play value comprises a generally planar, annular disc having a flange extending from the outer periphery thereof. The flange extends an equal distance from each side of the disc and is symmetrical about each side. The flange has a flat outer surface which enables the toy, when vertically oriented, to bounce off of a flat surface while maintaining the vertical orientation of the toy. To impart the desired bounce characteristics, the flying disc toy is molded from a rigid, hard plastic, such as either a polycarbonate or a polyamide (nylon), and the disc is so dimensioned that when the toy is dropped in a vertical attitude, the toy apparently partially flattens in the area of contact with the ground, and then rebounds with sufficient force to give the toy a very high bounce characteristic. I have found that this bounce characteristic is a function not only of the characteristics of the particular plastic from which the toy is molded, but also of the dimensions of the annular disc. If the width of the disc (i.e., the difference between the outside diameter and the inside diameter) is too great, the disc will rebound much less than if properly dimensioned, and similarly, if the width is too little, the disc will rebound much less than if optimally dimensioned. In the first case where the width is too great, there is apparently not enough deflection of the annulus upon contact with the ground, and in the latter case, where the width is too narrow, the annulus flexes too much and loses too much energy upon contact with the ground.

I have found that a disc made of either one of the two materials described hereinabove and having an outside diameter of 9 inches, an inside diameter of 6 inches, a thickness of approximately $\frac{1}{8}$ inch, and a flange which extends approximately $\frac{1}{8}$ inch from each side of the disc, gives rise to the very high bounce characteristic of this invention. It also gives rise to a toy which has stability in flight in either a vertical plane or a horizontal plane. Furthermore, if the toy is thrown slightly askew from the vertical plane, the rotation of the toy will cause it, apparently through a gyroscopic effect, to move into a vertical attitude, in which attitude it will bounce correctly from a rigid, vertical wall or from a flat, horizontal surface.

The primary advantage of this invention is that it has far greater play value than prior art flying disc toys. Specifically, it has many of the play value characteristics of a bouncing ball, but additionally has the play value characteristic of a flying disc.

These and other advantages of this invention will become readily apparent to persons skilled in this art from the following description of the drawings in which.

Figure 1:
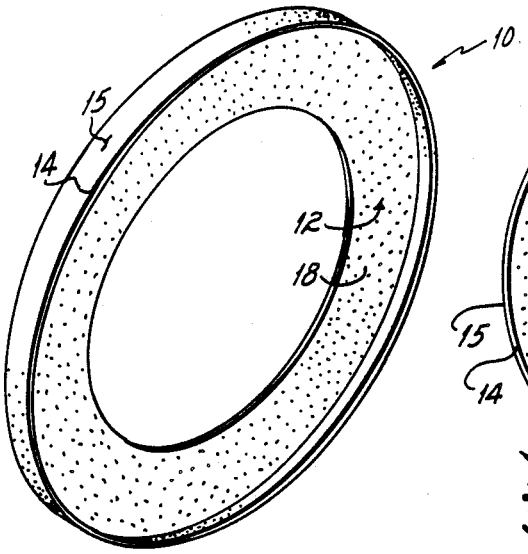
FIG. 1 is a perspective view of a flying disc toy incorporating the invention of this application.
Figure 2:
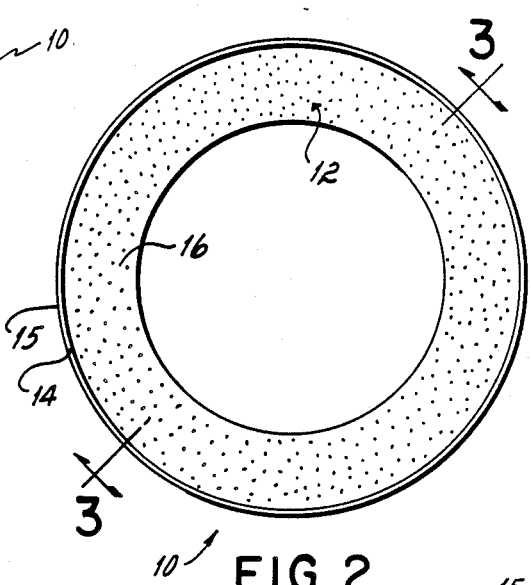
FIG. 2 is a top plan view thereof.
Figure 3:
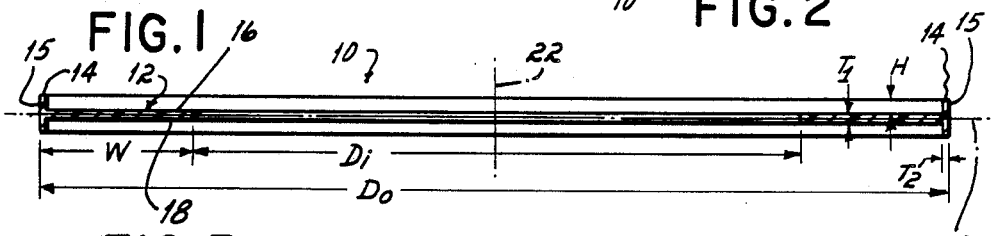
FIG. 3 is a cross-sectional view taken on line 3—3 of FIG. 2.

With reference to the drawings, it will be seen that the flying disc toy 10 of this invention comprises a molded, flat, annular disc 12 from which there extends a peripheral flange 14. This flange extends an equal distance H (FIG. 3) from each side 16, 18 of the disc. Consequently, the disc toy 10 is symmetrical on each side of the toy. Otherwise expressed, the toy is symmetrical on both sides about a plane 20 which extends through the center of the disc 12 and is parallel to the opposite sides of the disc.

In one preferred embodiment of the invention, the toy 10 is molded from a polycarbonate plastic. One particular polycarbonate which has been found to be particularly suitable for the practice of this invention is designated by its manufacturer, Enichem Polimeri SPA, of Milan, Italy, as "Sinvet" TM type R-221. In another preferred embodiment, the toy 10 is molded from a polyamide plastic. One particularly polyamide which has been found to be particularly suitable to the practice of this invention is designated by its manufacturer, E. I. DuPont de Nemours & Co., Inc. of Wilmington, Delaware, as "Zytel" ST 801. The material from which the toy is molded must be rigid and durable. It preferably has a Rockwell hardness when measured on the M scale of from 65 to 80 and an impact resistance when measured by the Izod Impact Test of from 14 to 16. As a consequence of these properties, it will not shatter or break when thrown against a rigid wall or surface and will, as explained more fully hereinafter, have the requisite "bounce" characteristics. Irrespective of which of these two materials, though, from which the flying disc toy is molded, the preferred embodiment has an outside diameter $D_o$ of 9 inches, an inside diameter $D_i$ of 6 inches, and a thickness $T_1$ of $\frac{1}{8}$ inch. The flange 14 extends a height H of $\frac{1}{8}$ inch from each side 16, 18 of the annular disc. The flange had a thickness $T_2$ of $\frac{1}{8}$ inch.

The flying disc toy having the dimensions and characteristics described hereinabove has been found to be stable in flight when thrown with the axis 22 of the disc located in a vertical plane and the disc located in a horizontal plane. When the toy 10 is to be thrown as a flying disc with the disc in a horizontal attitude, the edge of the flange is grasped between the thumb and forefinger, and the toy is usually thrown backhand so as to impart a rotation about the axis 22 to the toy as it flies through the air. This rotation causes the toy to remain in a horizontal attitude, apparently as a result of a gyroscopic effect created by rotation of the toy as it flies through the air.

Figure 4:
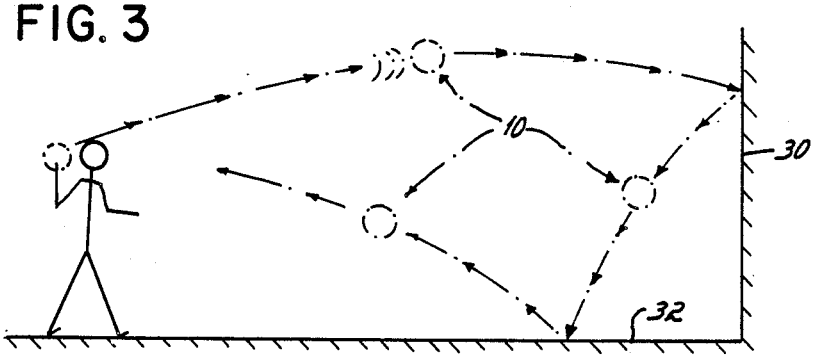
FIG. 4 is a diagrammatic illustration of one manner of play with the toy of this invention.
Figure 5:
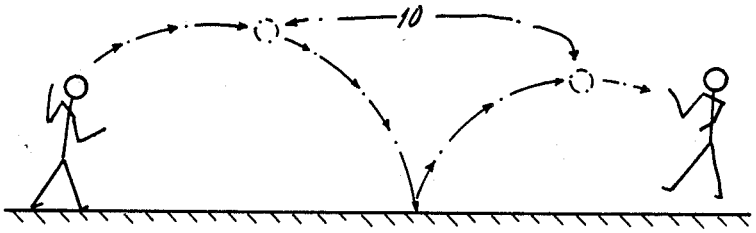
FIG. 5 is a diagrammatic illustration of a second manner of play with the toy of this invention.

Alternatively, and as illustrated in FIGS. 4 and 5, the toy may be thrown while maintained in a vertical attitude. To that end, the toy may be thrown either overhand or underhand with the axis 22 of the toy located in a horizontal plane and with the annular disc 12 of the toy located in a vertical plane. When the toy is thrown in this manner, the edge of the toy is grasped between the thumb and forefinger, and the toy is thrown so as to impart rotation to the toy as it flies through the air. This rotation causes the toy to remain in a vertical plane, or if it is thrown slightly askew from a vertical plane, to move into a vertical plane; again, apparently because of a gyroscopic effect. When the toy is thrown in this vertical attitude, it may be thrown and bounced between two players who catch it (FIG. 5), or it may be thrown as illustrated in FIG. 4 against a vertical wall 30 from which it will bounce back to the thrower in much the same way that a tennis ball or golf ball may be thrown against a wall and will bounce back to the thrower. Generally, when the toy is used in the fashion illustrated in FIG. 4, it is thrown with such a velocity as to hit the vertical wall 30, bounce from the vertical wall down to the ground 32, and bounce off of the group back to the player. Because of the bounce characteristics of the toy 10 described hereinabove, it will generally bounce at least two-thirds of the height from which it is dropped. In fact, a toy disc 10 manufactured from the material and having the dimensions described hereinabove will bounce at least 3 feet, 6 inches when dropped from a 4-foot height. Consequently, the toy can be used in much the same way that a ball is used to bounce off of a wall or to bounce off of a hard ground surface between two players.

It has been found that the material from which the flying disc 10 is manufactured is one critical parameter to the bounce characteristic of the toy 10. The toy must be made of a material which has a rigidity and hardness which is sufficient to impart to the flying disc the requisite bounce without breakage or permanent deformation. It has also been found that the width W, as well as the thickness $T_1$ of the disc, is critical to the bounce. Apparently, upon contact with the ground, the disc deflects from a circular outside diameter configuration to a non-circular configuration having a flat on one side. That flat then rebounds to impart the energy necessary to cause the disc to bounce to a great height. If the width W of the disc is increased substantially or decreased substantially, the disc will not bounce to the height described hereinabove. For example, it has been found that if the inside diameter of the toy is decreased to 3 inches, all other dimensions and materials remaining the same as described hereinabove, the toy will bounce approximately 66 percent of the height from which it is dropped, as opposed to the 85 percent or greater rebound of the preferred embodiment. Furthermore, it will not fly with the same desired flight characteristics. Alternatively, if the inside diameter is increased to 8 inches, all other conditions and parameters remaining the same, the toy will bounce approximately 66 percent of the height from which it is dropped instead of the 85 percent or greater of the preferred embodiment. Alternatively, if the material from which the disc is molded is changed to a softer material, the disc will have less bounce, i.e., will bounce to a lesser height when dropped from a height of 4 feet, for example. Otherwise expressed, it has been found that the physical characteristics of the material, as well as the configuration of the disc, all contribute and interact to impart to the disc its flight and bounce characteristics. Additionally, the flange 14 on the disc functions to give to the disc its flight characteristics, as well as its straight bounce. This flange 14 with its flat, peripheral surface 15 causes the flying disc toy 10 to bounce vertically and maintain vertical stability. In the absence of this flange and of its flat outer surface 15, the toy 10 would not maintain its vertical attitude when bounced off of a wall or off of a rigid ground surface.

While I have described only two preferred embodiments of my invention, persons skilled in this art will appreciate changes and modifications which may be made without departing from the spirit of my invention. For example, the plastic material of which the disc is manufactured may be altered and compounded of different plastic so as to give rise to the requisite bounce characteristics of this invention. Additionally, the dimensions of the disc may be changed slightly without departing from the spirit of my invention. Therefore, I do not intend to be limited except by the scope of the following appended claims:

I claim:

1. A flying disc toy which is to be thrown through the air while rotating about the axis of the disc toy and while oriented either horizontally or vertically, and which when thrown while rotating about a vertical axis will maintain its horizontal orientation, and which when thrown while rotating about a horizontal axis will maintain its vertical orientation even when bounced off of a wall or off of a flat horizontal surface, said flying disc toy comprising a generally planar annular disc having a flange extending from outer periphery, said flange extending an equal distance from each side of said disc, said flange being symmetrical on opposite sides of said disc, said flange having an outer surface configured to enable said disc toy when oriented vertically to bounce off of a flat surface while maintaining its vertical orientation, the dimensions of said annular disc toy and the material from which the annular disc is made being such that when the toy is dropped vertically and bounced off its peripheral edge, said toy bounces a minimum of approximately two-thirds of the height from which it was dropped, said disc being approximately 9 inches in outside diameter and approximately 6 inches in inside diameter, said annular disc being approximately $\frac{1}{8}$ inch in thickness and said flange extending approximately $\frac{1}{8}$ inch from each side of said disc.

2. A flying disc toy which is to be thrown through the air while rotating about the axis of the disc toy and while oriented either horizontally or vertically, and which when thrown while rotating about a vertical axis will maintain its horizontal orientation, sand which when thrown while rotating about a horizontal axis will maintain its vertical orientation even when bounced off of a wall or off of a flat horizontal surface, said flying disc toy comprising a generally planar annular disc having a flange extending from outer periphery, said flange extending an equal distance from each side of said disc, said flange being symmetrical on opposite sides of said disc, said flange having an outer surface configured to enable said disc toy when oriented vertically to bounce off of a flat surface while maintaining its vertical orientation, the dimensions of said annular disc toy and the material from which the annular disc is made being such that when the toy is dropped vertically and bounced off its peripheral edge, said toy bounces a minimum of approximately two-thirds of the height from which it was dropped, said disc having an outside diameter and an inside diameter, and wherein the difference between said diameters is approximately 3 inches, said disc having a thickness of approximately $\frac{1}{8}$ inch, and said flange extending approximately $\frac{1}{8}$ inch from opposite sides of said annular disc.

* * * * *

UNITED STATES PATENT AND TRADEMARK OFFICE

CERTIFICATE OF CORRECTION

PATENT NO. : 4,915,661

DATED : April 10, 1990

INVENTOR(S) : William F. Getgey

It is certified that error appears in the above-identified patent and that said Letters Patent is hereby corrected as shown below:

In column 4, line 15, please change "group" to --ground--.

Signed and Sealed this

Twentieth Day of August, 1991

*Attest:*

HARRY F. MANBECK, JR.

*Attesting Officer*

*Commissioner of Patents and Trademarks*